United States Patent [19]

Wagner

[11] Patent Number: 4,647,335

[45] Date of Patent: Mar. 3, 1987

[54] APPARATUS FOR MAKING CAST IN PLACE TOP CLAMP BAR GASKET

[75] Inventor: William L. Wagner, Warren, Pa.

[73] Assignee: Petrex, Inc., Warren, Pa.

[21] Appl. No.: 754,735

[22] Filed: Jul. 15, 1985

[51] Int. Cl.[4] ..... B32B 31/30

[52] U.S. Cl. ..... 156/500; 52/221; 52/744; 156/578; 277/1

[58] Field of Search ..... 156/500, 538, 578; 118/56, 100, 123, 313, 315; 277/1; 52/221, 744

[56] References Cited

U.S. PATENT DOCUMENTS

| | | | |
|---|---|---|---|
| 4,296,540 | 10/1981 | Potter | 52/744 |
| 4,296,932 | 10/1981 | Grobler | 277/1 |
| 4,431,198 | 2/1984 | Benhaur et al. | 52/221 |
| 4,564,410 | 1/1986 | Clitheros et al. | 156/578 |

*Primary Examiner*—Caleb Weston

*Attorney, Agent, or Firm*—Charles L. Lovercheck; Wayne L. Lovercheck; Dale R. Lovercheck

[57] ABSTRACT

A process and structure of a joint for connecting a first panel and a second panel of a floating roof. Each panel being including an extrusion on an edge of said panel. The extrusions being generally U-shaped and each extrusion having two spaced ribs. The clamping bars, each clamping bar having two spaced slots that receive a said rib on each of the panels. The ribs being received in two spaced slots and the bars being clamped together. Before inserting the ribs in the slots a thin uniform layer of an elastomeric material is dispensed in the grooves and struck off to a uniform thickness and cured before inserting the bar into position on said extrusions.

3 Claims, 6 Drawing Figures

APPARATUS FOR MAKING CAST IN PLACE TOP CLAMP BAR GASKET

BACKGROUND OF THE INVENTION

A floating roof panel for use in liquid storage tanks for volatile products are well known. It is important in such floating panels to provide a vapor seal at the panel joints to prevent leakage. Honeycomb type panels have been used as floating roofs. These panels were joined together with clamps and were allowed some small amount of volatile vapors to escape.

REFERENCE TO PRIOR ART

The following patents are noted which show various methods for sealing joints and sealed joints.

U.S. Pat. No. 2,235,937 to Linberg
U.S. Pat. No. 2,646,065 to Tyson
U.S. Pat. No. 2,677,633 to Gross
U.S. Pat. No. 3,125,346 to Poltorak
U.S. Pat. No. 3,368,005 to Buczala et al
U.S. Pat. No. 3,593,799 to Boughton et al
U.S. Pat. No. 4,012,822 to Vrolyk et al
U.S. Pat. No. 4,295,259 to Rhodes et al
U.S. Pat. No. 4,296,540 to Potter
U.S. Pat. No. 4,296,932 to Grobler
U.S. Pat. No. 4,431,198 to Beinhauer et al None of these patents show a method for sealing joints such as disclosed herein.

STATEMENT OF THE INVENTION

The invention disclosed herein involves casting a thin layer of an elastomeric material into a groove which will harden and then be squeezed when a mating member is applied to it in providing a joint for joining together two panels. The elastomeric material is dispensed into two parallel grooves in a clamping bar. The elastomeric material is then struck off with a striking tool having ribs projecting into the grooves, complementary in shape to the shape of the grooves thereby providing a thin uniform layer of the elastomeric material on the surface defining the grooves and allowing the elastomeric material to harden and squeezing the clamping bar against the panel and then joining the panels together with elastometric material therebetween.

This method results in a gas and vapor tight joint which will resist leakage and allow flexing of the two panels that are joined together by the joint.

OBJECTS OF THE INVENTION

It is an object of the invention to provide an improved joint and method for making a joint between two panels.

Another object of the invention is to provide an improved floating roof panel combination with the improved joint.

Another object of the invention is to provide an improved method of making a joint in roof panel construction including a clamp bar gasket.

Another object of the invention is to provide a roof panel that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

DETAILED DESCRIPTION OF THE DRAWINGS

Figure 1:
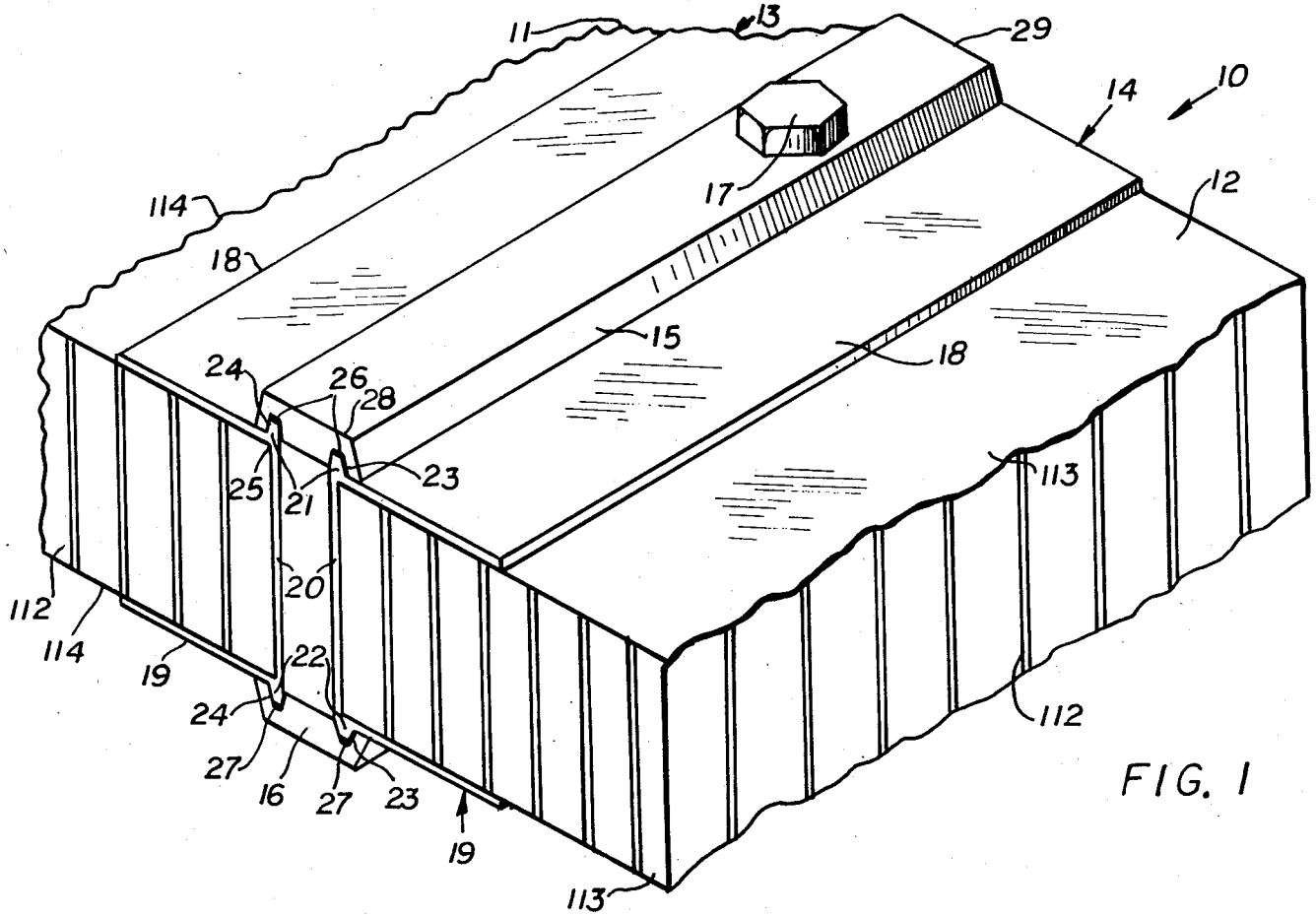
FIG. 1 is an isometric view of a part of a floating roof panel according to the invention.
Figure 3:
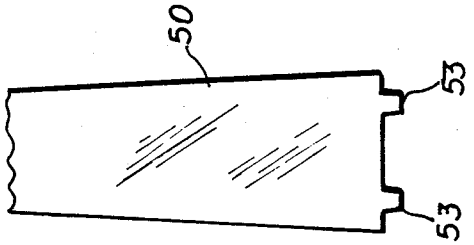
FIG. 3 is an end view of the strike off tool for leveling the cement.
Figure 2:
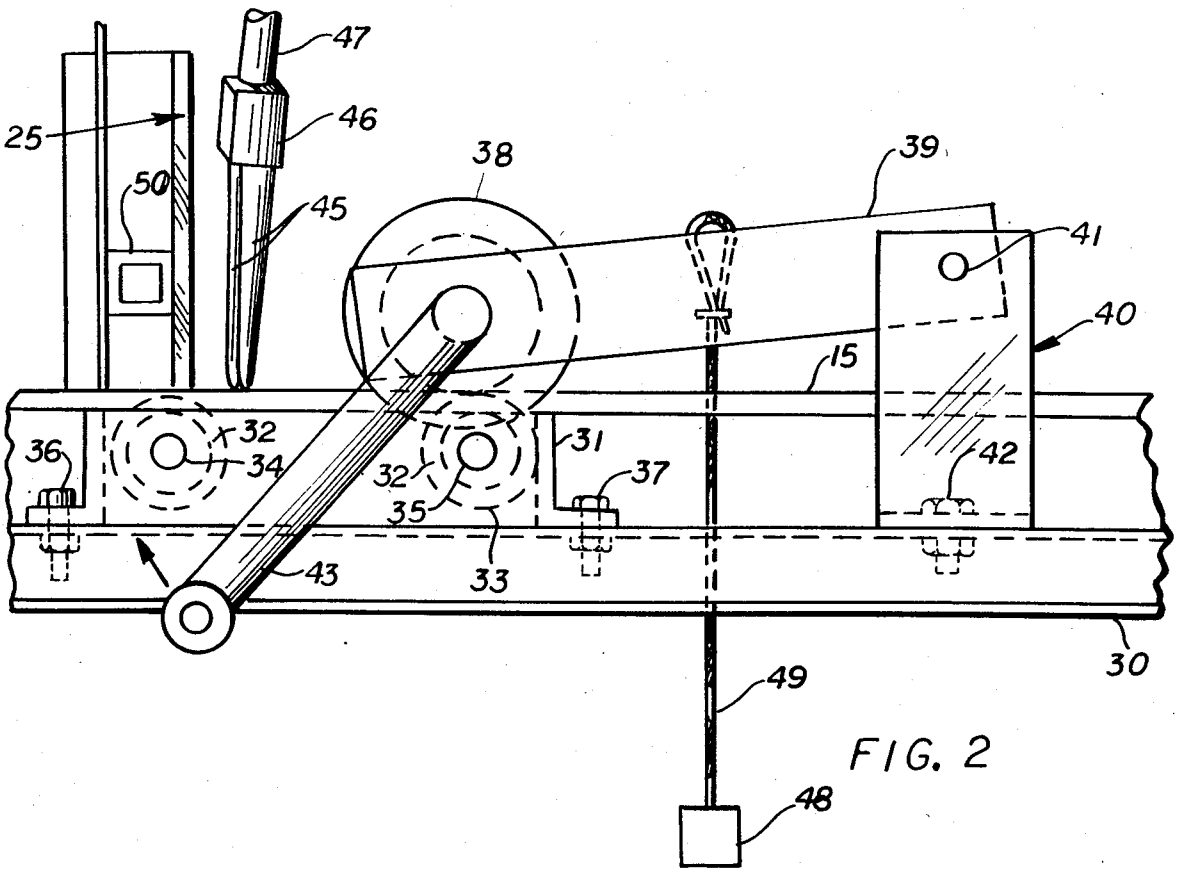
FIG. 2 is an outlined view of the apparatus used for carrying out the method of the invention.
Figure 6:
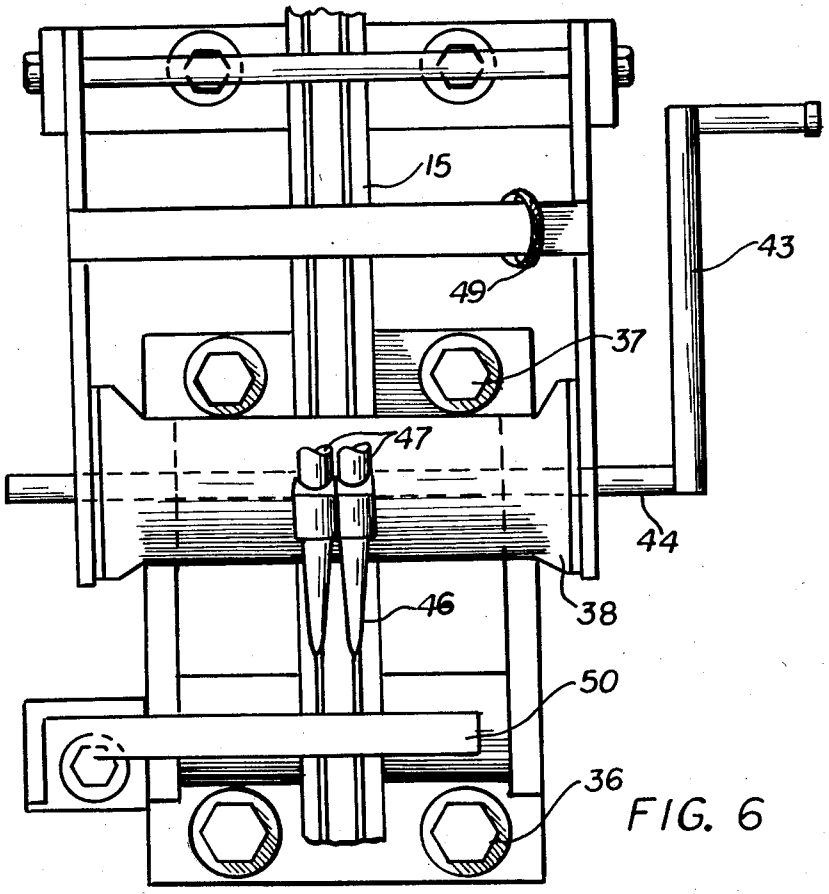
Figure 5:
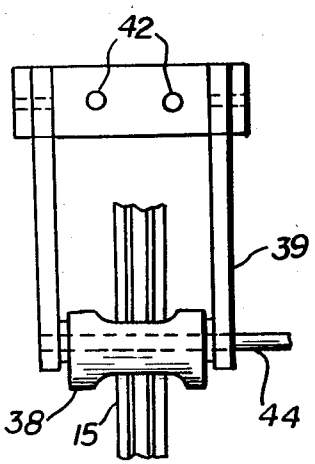
FIG. 5 is a top view of a part of the apparatus shown in FIG. 4.
Figure 4:
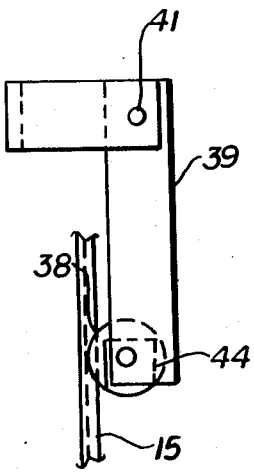
FIG. 4 is a side view of a part of the apparatus shown in FIG. 2.

Now with more particular reference to the drawings, FIG. 1 shows a section of a floating roof made according to the invention. The section of the floating roof indicated at 10 is made up of a first panel 11, a second panel 12, a first extrusion 13, a second extrustion 14, a first clamping bar 15, a second clamping bar 16 and studs 17 which clamp the bars 15 and 16 together. The panels 11 and 12 are made of "honeycombed" material 112 standing on edge and sandwiched between the sheets 113 and 114 which may be sheets of aluminum or other suitable rigid material. Each of the adjacent edges of the panels 11 and 12 are received between the spaced plate-like legs 18 and 19 of one of the U-shaped extrusions 13 and 14. The plate-like legs 18 and 19 of the extrusions are connected together by the plate-like flanges 20. The legs 13 and 14 are generally disposed perpendicular to flanges 20. The first extrusion 13 and second extrusion 14 each have a first rib 21 and second rib 22. The first rib 21 on each of the extrustions 13 is integrally attached to the first leg 18 and to the flange forming a continuation of the flange 20. The second rib 22 on each of the extrusions is integrally attached to the second leg 19 and to the flange 20 forming a continuation of the flange 20. The first clamp bar 15 and second clamp bar 16 each have a first longitudinally extending groove 23 and a second longitudinally extending groove 24. The longitudinally extending groves 23 and 24 are spaced from each other and are parallel to each other and are complementary in shape to the shape of the ribs 21 and 22 of the extrusions. The first clamping bar 15 has holes which receive the bolts 17 and the second bar 16 may have threaded holes which receive a threaded end of the bolt 17. The ribs 21 and 22 each have a first side wall 25 and a second side wall 26. Side walls 25 and 26 are connected by end wall 27. The first side wall 25 of each of the ribs 21 and 22 forms a continuation of the surface of the flange 20. The grooves in the clamping bar 15 and 16 are complementary in shape to the ribs 21 and 22.

The apparatus for carrying out the method according to the invention is shown in FIGS. 2, 3, 4, 5 and 6. The apparatus has a frame 30 in the form of an inverted channel to which the bracket 31 is attached. Each of rollers 32 and rollers 38 has a central groove midway between its ends for receiving the clamp bars 15. The bracket 31 carries the spaced grooved polyethylene rollers 32 and 33 which are rotatably supported on the axles 34 and 35 respectively. The bracket 31 is held to the channel frame 30 by the bolts 36 and 37. The upper roller 38 is supported on the swinging arm 39 which is pivotedly supported on the post 40 by the pivot 41. Upper roller 38 engages the top of clamp bar 15 and drives clamp bar 15 over rollers 32 and 33. Bracket 40 is attached to the frame 30 by means of the bolts 42. A crank handle 43 is connected to the upper roller 38 and is rotated manually in a direction of the arrow to move the clamp bar 15 through the apparatus to carry out the method. The upper roller 38 is connected to the axle 44 which has the crank 43 connected to it. Two nozzles 45 are supplied elastomeric material by hoses 47 connected to the block 46 which is connected to a dispensing hose 47 which may be connected to a source of elastomeric material. The nozzles 45 are spaced equal to the spacing of the grooves 23 and 24 in the clamp bars 15 and 16. Block 46 is supported on frame 30.

A weight 48 is attached to the bar 39. The weight 48 is connected to the bar 39 by a cord 49 to apply a uniform pressure to the rollers 38. The rollers may be commercial rollers made of plastic or other suitable material. After the material is extruded from nozzle 45 into the grooves in the clamp bar, a striking tool 50 is drawn through the grooves to evenly distribute the material. The striking tool can be handled manually or it may be supported on the frame 30. After the elastomeric material has set for a suitable length of time, the clamping bars 15 may be applied to the extrusions to assemble the honeycomb panels as shown in FIG. 1. The striking tool 50 has two spaced ribs 53 and 54 which are complimentary in shape to the shape of grooves 23 and 24. These ribs run through the grooves after elastomeric material has been dispensed into them and spread the material to a uniform depth. Nozzles 45 are supported on column 25 which are attached to frame 30 and have their ends disposed adjacent grooves in the clamp bar 15.

When the panels 11 and 12 are placed in side by side relation and connected by clamping bars 15 and 16 disposed with ribs 21 and 22 received in grooves 23 and 24 and bars 15 and 16 drawn together by bolts 17 a floating cover with a gas tight joint will be provided.

The material used for the adhesive may be one of the following materials:

(a) Two-part, polysulfide, liquid polymer compound (b) One-part, silicon, liquid compound (c) Other elastomeric material that are compatable with products stored in the tank connected to hoses 47.

The time allowed for the material before use will be about 120 minutes. The ribs 53 on the striking tool 50 will be approximately the same size and shape of the ribs 21 on the extrusions.

To operate the device, a clamp bar 15, crank handle 43 is rotated with the adhesive turned on to dispense from the nozzles 45 and the weight 48 on the lever 39 will be approximately five pounds which will exert a constant force by upper roller 38 to develop the necessary frictional force to drive the clamping bar 15 over the rollers 33 and 34 on the arm 39 into intimate contact with the cement to provide a coating of adhesive of uniform thickness in grooves 23 and 24.

The foregoing specification sets forth the invention in its preferred, practical forms but the structure shown in capable of modification within a range of equivalents without departing from the invention which is to be understood is broadly novel as is commensurate with the appended claims.

The embodiments of the invention in which an exclusive property or privilege is claimed are defined as follows:

1. An apparatus for applying as elastomeric material to space longitudinally extending grooves in elongated generally plate-like clamp bars comprising:

a frame made of an inverted channel, spaced upwardly extending first brackets attached to said frame, longitudinally spaced laterally extending first axles supported on said first brackets, polyethylene first rollers on each said first axles, a central groove extending around each said first rollers midway between its ends receiving a said clamp bar therebetween, laterally spaced second brackets attached to said frame and longitudinally spaced from said first bracket and extending upwardly above said first brackets, an elongated arm having a first end and a second end, said first end of said arm having second axle means therein swingably supporting said first end of said arm on said second brackets, third axle means rotatably supported on said second end of said arm, a second roller member, said second roller member having a reduced size intermediate part having a length substantially equal to the width of said clamp bars, said reduced size intermediate part of said second roller member being adapted to engage a said clamp bar, a crank on said second roller member for rotating said second roller member to drive a said clamp bar over said first rollers, a cord attached to said arm between said second roller member and said second brackets and weight means attached to said cord for imposing a weight on said arm to hold said second roller member in engagement with a said clamp bar supported on said first rollers whereby said second roller member is forced into a frictional engagement with said clamp bars, spaced downwardly extending nozzle means supported on said frame, said nozzle means being spaced from each other a distance equal to the spacing of said longitudinal extending grooves in said clamp bars, a plate-like strike off blade attached to said frame, said strike-off blade having ribs formed thereon spaced equal to the spacing of said longitudinally extending grooves in said clamp bars, said ribs on said strike-off blade being complementary in shape to the cross-sectional shape of said grooves in said clamp bars, said clamp bars being adapted to be successively laid on said first rollers with said longitudinally extending grooves disposed upwardly and said nozzle means overlying said groove, said ribs on said strike-off blade being disposed in said grooves, said second roller member being held in engagement withsaid clamp bars by said weight member, said crank rotatably moving said clamp bars under said nozzle means and said strike-off blade whereby a layer of elastomeric material of substantially uniform thickness is deposited in said grooves in said clamp bars, said clamp bars being adapted to be applied to adjacent edges of two panels each having a rib adjacent each end of said panels after said elastomeric material is applied to said grooves, said ribs being complementary in shape to said groove in said clamp bars whereby said panels are held together.

2. An apparatus for applying an elastomeric material to spaced longitudinally extending grooves in elongated generally plate-like clamp bars comprising:

a frame made of an inverted channel having a bottom, spaced upwardly extending first support means attached to said frame, longitudinally spaced laterally extending first axles supported on said first support means, a thermoplastic first roller on each said first axle, a central groove extending around each said first roller midway between its ends receiving a said clamp bar therebetween, laterally spaced second support means attached to said frame and longitudinally spaced from said first bracket and extending upwardly above said first support means, an elongated arm having a first end and a second end, said first end of said arm having second axle means therein swingably supporting said first end of said arm on said second support means, a second roller member, said second roller member having a reduced size intermediate part having a length substantially equal to the width of said clamp bars, means rotatably supporting said second roller member on said second end of said arm, said reduced size intermediate part of said second roller member being adapted to engage a said clamp bar, a crank on said second roller member for rotating said second roller member to drive a said clamp bar over said first rollers, a cord attached to said arm between said second roller member and said first end of said arm and weight means attached to said cord for imposing a weight on said arm to hold said second roller member in engagement with a said clamp bar supported on said first roller whereby said second roller member is forced into a frictional engagement with said clamp bars, spaced downwardly extending nozzle means supported on said frame, said nozzle means being spaced from each other a distance equal to the spacing of said longitudinally extending grooves in said clamp bars, a plate-like strike off blade attached to said frame, said strike-off blade having ribs formed thereon spaced equal to the spacing of said longitudinally extending grooves in said clamp bars, said ribs on said strike-off blade being complementary in shape to the cross-sectional shape of said grooves in said clamp bars, said clamp bars being adapted to be successively laid on said first rollers with said longitudinally extending grooves disposed upwardly and said nozzle means overlying said groove, said ribs on said strike-off blade being disposed in said grooves, said second roller member being held in engagement with said clamp bars by said weight member, said crank rotatably moving said clamp bars under said nozzle means and said strike-off blade whereby a layer of elastomeric material of substantially uniform thickness is deposited in said grooves in said clamp bars, said clamp bars being adapted to be applied to adjacent edges of two panels having a rib adjacent each end of said panels after said elastomeric material is applied to said grooves.

said ribs being complementary in shape to said grooves in said clamp bars whereby said panels are held together.

3. The apparatus recited in claim 2 wherein said thermoplastic is polyethylene.

* * * * *